US006737655B1

(12) United States Patent
Douglas et al.

(10) Patent No.: US 6,737,655 B1
(45) Date of Patent: May 18, 2004

(54) PASSIVE, ACHROMATIC, NEARLY ISOCHRONOUS BENDING SYSTEM

(75) Inventors: David R. Douglas, Yorktown, VA (US); Byung C. Yunn, Yorktown, VA (US)

(73) Assignee: Southeastern Univ. Research Assn., Inc., Newport News, VA (US)

( * ) Notice: Subject to any disclaimer, the term of this patent is extended or adjusted under 35 U.S.C. 154(b) by 0 days.

(21) Appl. No.: 10/307,075

(22) Filed: Nov. 29, 2002

(51) Int. Cl.[7] ..... H05H 7/10; H05H 13/00
(52) U.S. Cl. ..... 250/396 ML; 335/213
(58) Field of Search ..... 250/396 ML; 372/2, 372/18, 25; 335/213

(56) References Cited

U.S. PATENT DOCUMENTS 4,200,844 A * 4/1980 Nunan ..... 315/505
4,409,486 A * 10/1983 Bates ..... 250/396 ML

* cited by examiner

*Primary Examiner*—John R. Lee
*Assistant Examiner*—James J. Leybourne

(57) ABSTRACT

A particle beam bending system having a geometry that applies active bending only beyond the chord of the orbit for any momentum component. Using this bending configuration, all momentum components emerge dispersed in position only; all trajectories are parallel by construction. Combining a pair of such bends with reflective symmetry produces a bend cell that is, by construction, achromatic to all orders. By the particular choice of 45° individual bends, a pair of such achromats can be used as the basis of a 180° recirculation arc. Other rational fractions of a full 180° bend serve equally well (e.g., 2 bends/cell×90°/bend×1 cell /arc; 2 bends/cell×30°/bend×3 cells/arc, etc), as do combinations of multiple bending numerologies (e.g., 2 bends/cell×22.5°/bend×2 cells+2 bends/cell×45°/bend×1 cell). By the choice of entry pole face rotation of the first magnet and exit pole face rotation of the second magnet (with a value to be determined from the particular beam stability requirements imposed by the choice of bending angle and beam properties to be used in any particular application), desirable focusing properties can be introduced and beam stability can be insured.

4 Claims, 5 Drawing Sheets

PASSIVE, ACHROMATIC, NEARLY ISOCHRONOUS BENDING SYSTEM

The United States of America may have certain rights to this invention under Management and Operating contract No. DE-AC05-84ER 40150 from the Department of Energy.

FIELD OF THE INVENTION

The present invention relates to systems for the transport and recirculation of charged particle beams and more particularly to such a system that is passive, completely achromatic and nearly isochronous.

BACKGROUND OF THE INVENTION

The recirculation of energized particles in, for example, a particle accelerator, free electron laser or the like device is a well recognized method and much effort has been devoted to the design and implementation of a variety of systems to reduce the technical requirements of such systems while providing a recirculated particle beam that is of relatively uniform cross-sectional profile, i.e. well defined, timed to meet the requirements of the acceleration field, and linearly consistent. The objective in such systems is, of course, to be able to produce a focused and compact stream of particles and to reintroduce that stream of particles into the accelerator field at the appropriate time so as to achieve maximum energization thereof, or, alternatively, to make the particles coincident with a decaying portion of the oscillating field so as to impart the particle energy to the accelerator field. Additionally, the temporal behavior of the recirculated particle beam should be should be consistent, i.e. bunches of particles should remain linearly arranged. The production of such a recirculated particle beam, of necessity because of the design of accelerators and the like, requires that the beam be bent or turned from one "exit" position as it exits the accelerator and reinserted into a "start" or introduction point up stream of the exit point Such manipulation of the beam generally requires bending the beam through two 180° turns as will be described further below in connection with FIG. 1.

Currently used systems may utilize very intense and uniform magnetic fields to achieve this particle beam manipulation and often affect the timing, profile and bunch, i.e. linear, arrangement within the recirculated particle beam.

OBJECTS OF THE INVENTION

It is therefore an object of the present invention to provide a simplified solution the problem of turning the recirculated particle beam.

It is another object of the present invention to provide a particle beam turning system that requires less intense and/or uniform magnetic fields.

It is yet a further object of the present invention to provide a particle beam bending system that is nearly isochronous, i.e. maintains the temporal characteristics of the recirculated beam, and is otherwise less invasive on the properties of the transported beam of particles.

It is yet another object of the present invention to provide a particle beam bending system that supplies a recirculated particle beam that well ordered in terms of bunch location therein, i.e. the path length of the particle trajectories should vary only linearly with particle momentum.

SUMMARY OF THE INVENTION

According to the present invention, there is provided a particle beam bending system having a geometry that applies active bending only beyond the chord of the orbit for any momentum component. As a consequence, all momentum components emerge dispersed in position only; all trajectories are parallel by construction. Combining a pair of such bends with reflective symmetry produces a bend cell that is, by construction, achromatic to all orders. By the particular choice of 45° individual bends, a pair of such achromats can be used as the basis of a 180° recirculation arc. Other rational fractions of a full 180° bend serve equally well (e.g., 2 bends/cell×90°/bend×1 cell/arc; 2 bends/cell×30°/bend×3 cells/arc, etc), as do combinations of multiple bending numerologies (e.g., 2 bends/cell×22.5°/bend×2 cells+2 bends/cell×45°/bend×1 cell).

DESCRIPTION OF THE DRAWINGS

The instant specification will be better understood when read in light of the accompanying drawings wherein like numerals refer to like elements.

DETAILED DESCRIPTION

Figure 1:
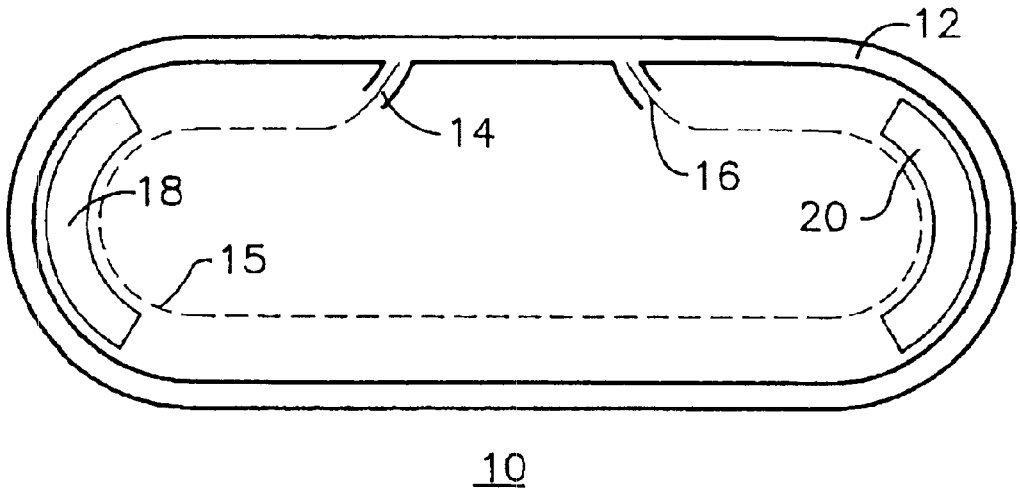
FIG. 1 is a schematic diagram of a system of the type in which the apparatus and method of the present invention find use.

Referring now to FIG. 1 that shows a schematic diagram of an accelerator or other device that requires the recovery of a particle beam such as an electron, proton, ion, etc. beam, device 10 comprises a field (RF, IR, etc.) chamber 12 an exit port 14 in field chamber 12 from whence the energy recovery beam 15 is dumped, an entry port 16 where recovered/recirculated particle beam 15 is reintroduced into field chamber 12 and a pair of turning systems 18 and 20 that receive recovered/recirculated particle beam 15, turn it approximately 180° and aim it for reinsertion into entry port 16.

Figure 2:
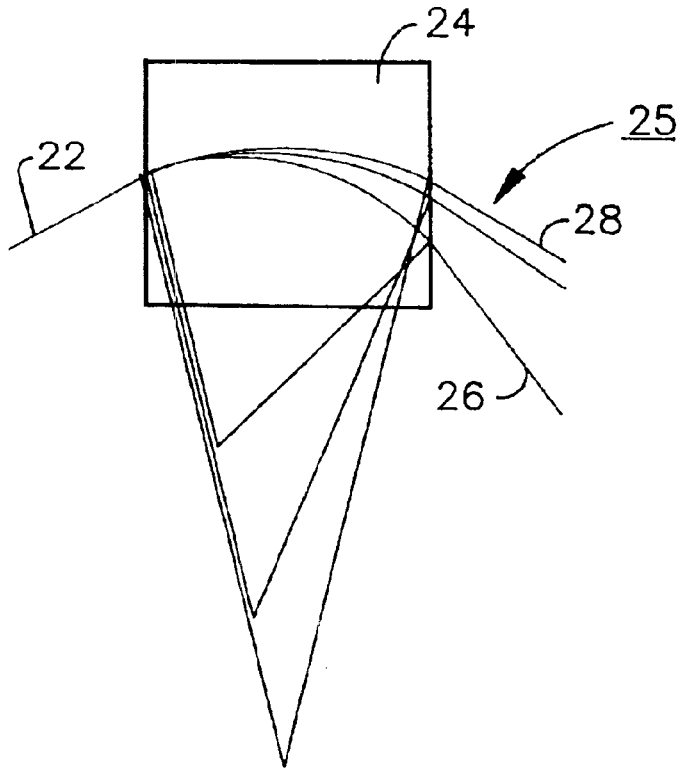
FIG. 2 shows the bending effect on a polychromatic beam in the conventional utilization of a magnetic bend.

Referring now to FIG. 2, the effect on a polychromatic beam in the conventional utilization of a magnetic bending system of the type depicted schematically at 18 and 20 in FIG. 1 is shown. As represented in FIG. 2, a particle beam to be recirculated 22 is directed into a magnetic field 24 (provided by a suitable dipole magnet, i.e. one whose entrance face and exit face are coplanar and thus described as a coplanar dipole magnet, for example). The bending induced by this action conventionally disperses beam 22 in position and angle according to its energy as shown at 25. In FIG. 2, the low energy or momentum/energy component 26 is bent the most while the highest momentum/energy component 28 is bent the least. Subsequent transport must actively suppress this dispersion (using reverse bending and/or focussing) if it is to be achromatic. This will, in general, make the position of the beam dependent on momentum (to at least some nonlinear order) and may result in degradation of beam quality.

Figure 3:
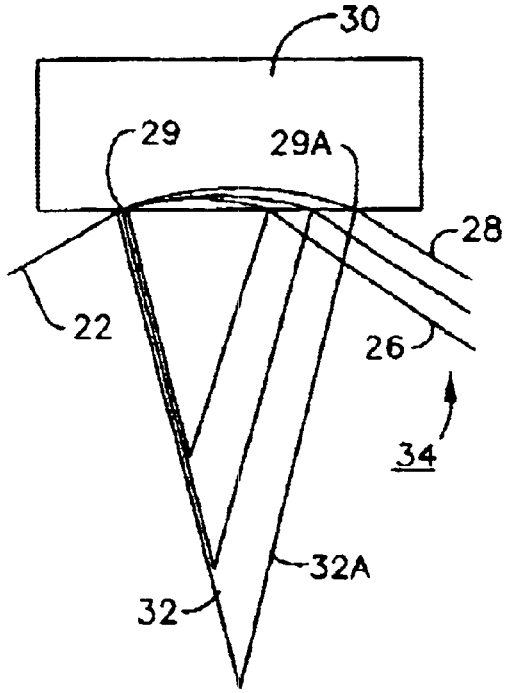
FIG. 3 shows the effect of an alternative implementation of a magnetic bend leading to dispersion in position only of the various momentum components of a polychromatic beam.

An alternate utilization is illustrated in FIG. 3. As shown in FIG. 3, recirculating beam 22 impacts magnetic field 30 only beyond the chords 32 and 32*a* of the orbit for any beam 22 component, i.e. beyond the chord of the highest momentum component 28. As a consequence, all momentum components emerge dispersed in position regardless of their momentum and all trajectories 34 are parallel by construction and remain linearly ordered.

Figure 4:
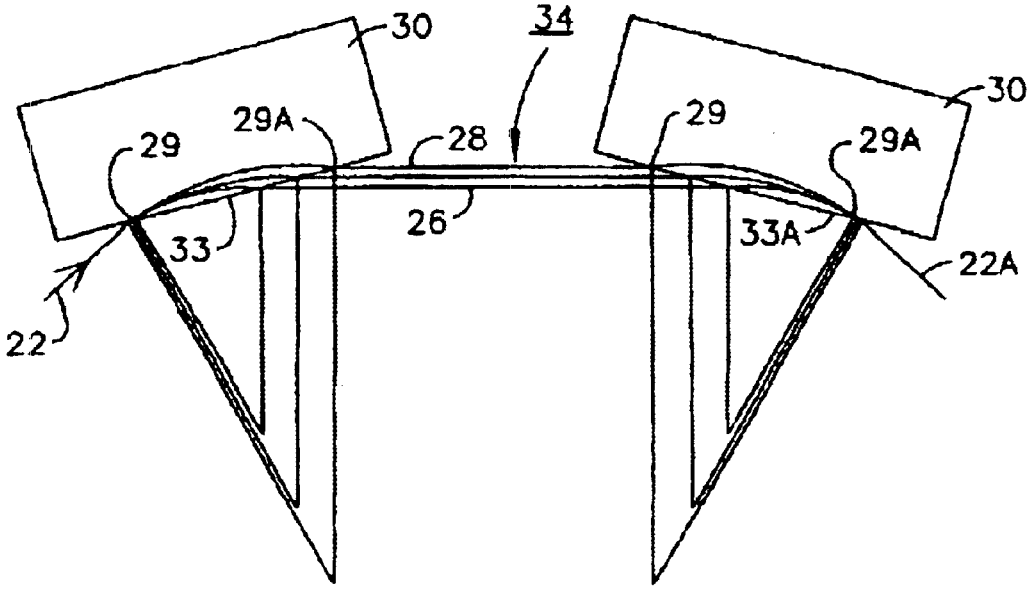
FIG. 4 depicts the novel geometry of the passive, completely achromatic and nearly isochronous bending system of the present invention.

As shown in FIG. 4, a pair of such bends (of the type depicted in FIG. 3) can be combined with reflective symmetry to produce a bend cell that is, by construction, achromatic to all orders. By the particular choice of 45° individual bends, a pair of such achromats can be used as the basis of a 18° recirculation arc. Other rational fractions of a full 180° bend would serve equally well (e.g., 2 bends/cell×90°/bend×1 cell/arc; 2 bends/cell×30°/bend×3 cells/arc, etc), as would combinations of multiple bending numerologies (e.g., 2 bends/cell×22.5°/bend×2 cells+2 bends/cell×45°/bend×1 cell). It is this combination of at least a pair of magnetic fields whose geometry applies active magnetic bending only beyond the chord of the orbit for any momentum component of the particle beam that forms the essence of the present invention.

FIG. 4 illustrates the details of the orbit geometry in this class of system. The triangles formed by the radii and chords of all orbits are similar, so that by construction all momentum components are parallel upon exit from dipole magnet 30.

Figure 5:
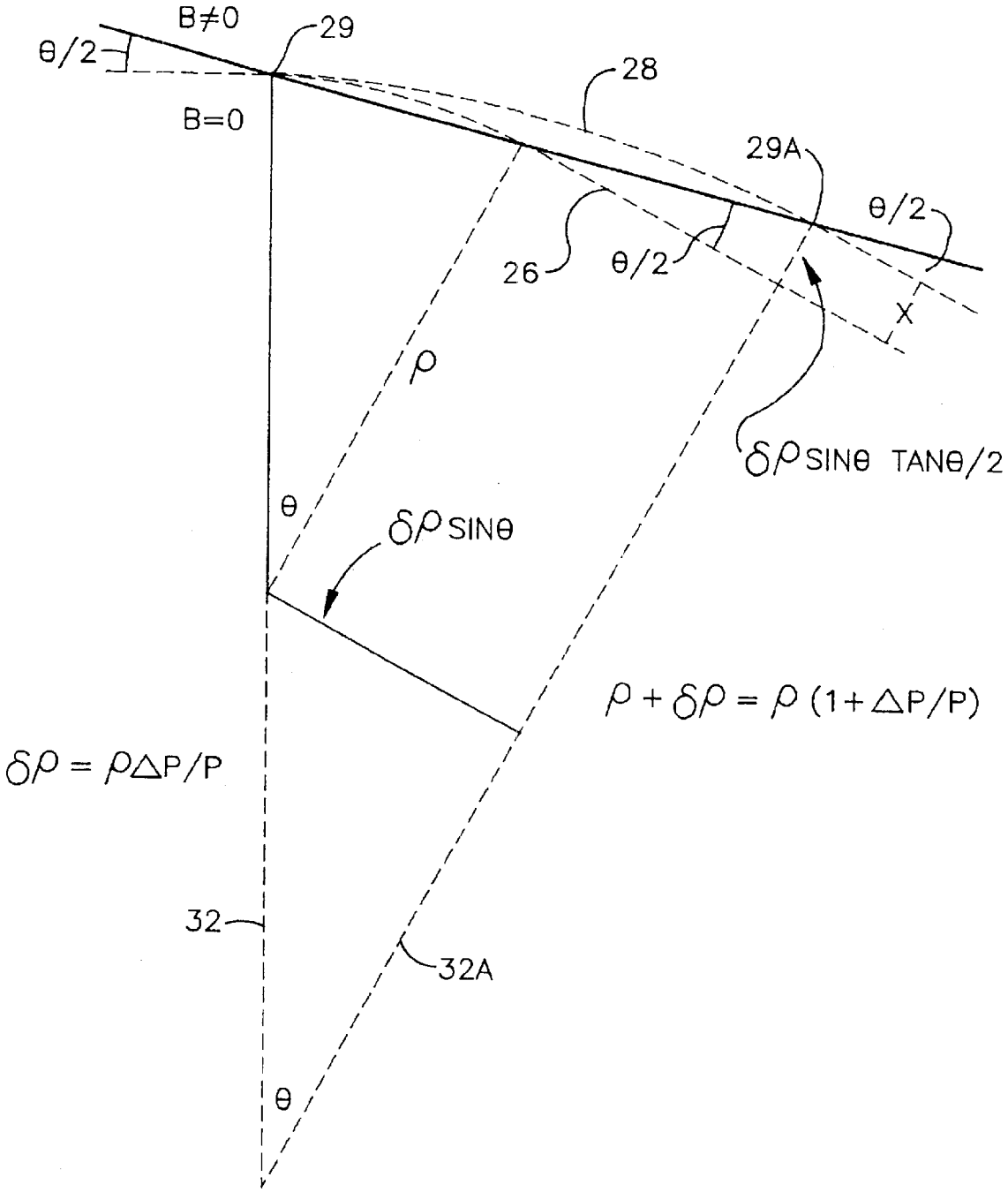
FIG. 5 is a diagram showing the geometry of one of the bending fields of the present invention.

As will be apparent from a study of FIG. 5, in the following discussion, the angle θ is the angle formed by the intersection of, for example, the chords 33 and 33A whose endpoints are defined by the points of incidence 29 with and deflection 29*a* from the magnetic fields produced by coplanar dipole magnets 30, of the highest momentum particles of particle beam 22. Three features of this geometry are worthy of note. First, all momentum components are dispersed along parallel orbits 34. Secondly, the dispersion function is completely linear as described below. Finally, the path length variation with momentum is completely linear as well, also as described mathematically below. The first assertion is obvious upon inspection of FIG. 3. This dipole geometry could thus well serve as the basis for a spectrometer or spectrographic system. The second feature is made apparent by noting that the offset x (See FIG. 5) of the higher momentum orbit from the lower is the following function of the relative momentum deviation.

$$x=x(\Delta p/p)=\delta\rho\sin\theta\tan\theta/2=\rho\Delta p/p\sin\theta\tan\theta/2.$$

This is completely linear in the momentum deviation Δp/p; we may therefore make the identification $$x(\Delta p/p)=\eta_x\Delta p/p=\rho\Delta p/p\sin\theta\tan\theta/2.$$

Thus, $$\eta_x=\rho\sin\theta\tan\theta/2$$

specifies the dispersed orbit for all momentum deviations. Similarly, the slope is given by $$x'(\Delta p/p)=\eta'_x\Delta p/p$$

with $$\eta'_x=0$$

to all order in the momentum offset. This is simply the substance of the previous assertion.

Figure 6:
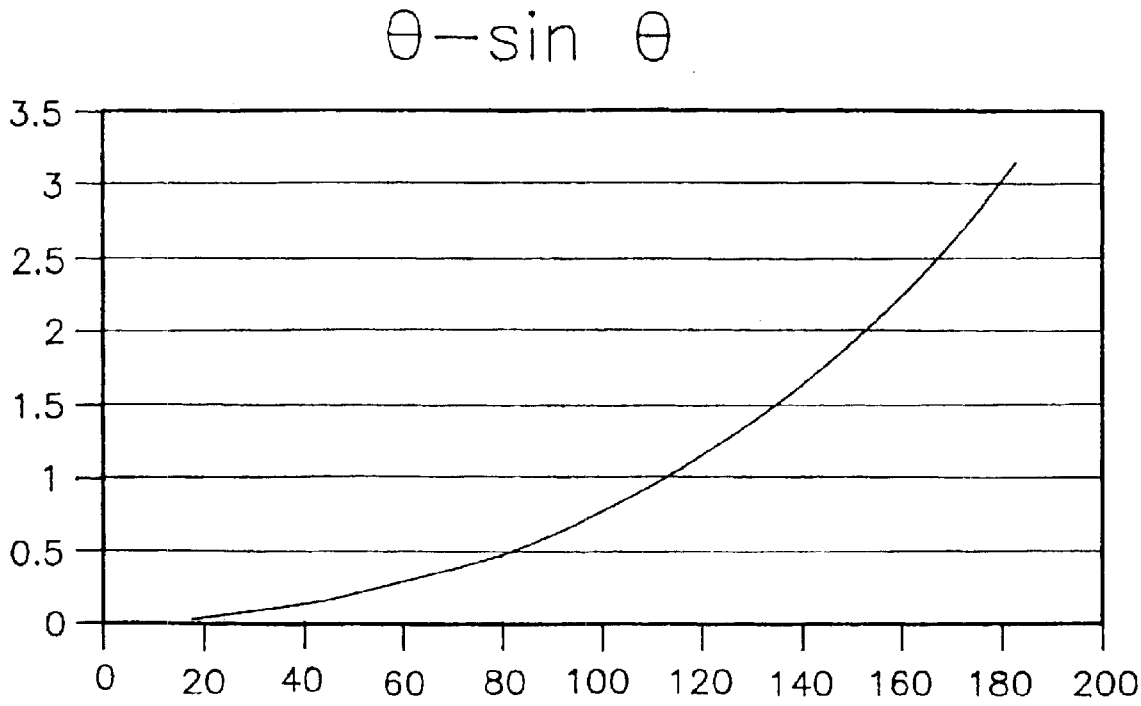
FIG. 6 is a graph showing the angular dependence of momentum compaction.

The final point is proven by noting the "shorter" (lower momentum) orbit, that of particles 26 is of length ρθ+δρ sin θ while the "longer" (higher momentum) orbit, that of particles 28 is of length (ρ+δρ)θ. The path length difference is therefore $$\delta 1=\delta\rho(\theta-\sin\theta)=\rho\Delta p/p(\theta-\sin\theta)$$

so that the compaction is therefore entirely linear, proportional to the base bend radius, and of only cubic and higher order in the bend angle. The functional dependence on bend angle is shown in FIG. 6 where it is noted that the compaction will be a small fraction of the bend radius for angles up to ~1 radian. Recirculation arcs based on this geometry (typically using 4 or more bends of 45° or smaller angle) will therefore be nearly isochronous if bends of modest radii are used. This is in contrast to the compaction of, for example, a FODO-cell based arc, which is typically on the order of the dispersion, which in turn is of magnitude similar to the bend radius.

Figure 7:
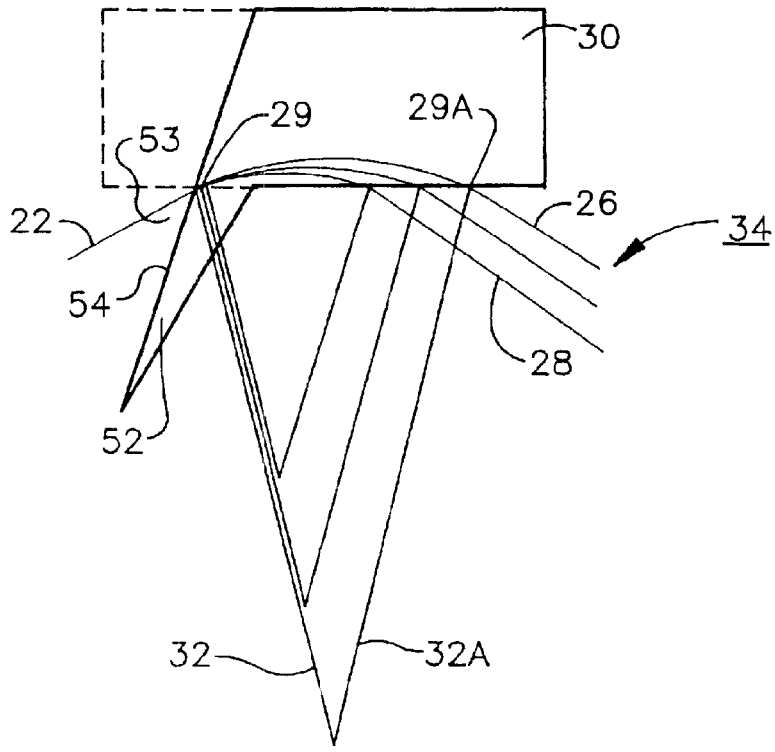
FIG. 7 depicts a modification of the dipole magnet geometry to improve betatron stability.

The geometry heretofore illustrated does possess a potential weakness in certain applications, the angle of the pole face relative to the transported beam is extremely large, so that the beam will experience extremely strong horizontal focusing and vertical defocusing upon transit of the bend. This can lead to betatron instability. This is countered, to some extent by the natural compactness of systems based on this dispersion suppression technique. Further alleviation of over-focusing can be achieved by a "counter-rotation" of the pole face straddling the nondispersed orbit. This is illustrated in FIG. 7. The "peninsula" 52 formed in the body of magnet 30 on the lower left corner of the bend, will, to some extent, limit the low-end off-momentum acceptance of the magnet; however, momentum acceptances approaching 100% will still be available.

Figure 8:
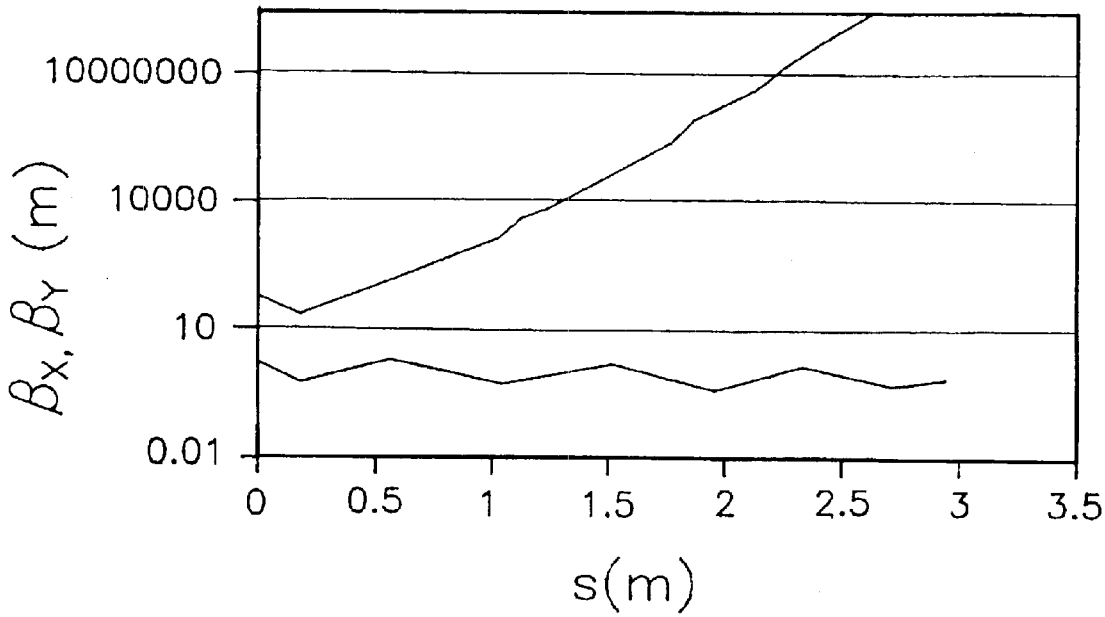
FIG. 8 is a graph showing the instability of beam envelopes in the bend geometry depicted in FIG. 3.

The effectiveness of this solution is illustrated in FIG. 8, wherein are presented beam envelope functions for a recirculation arc based on four 45° dipoles of ⅔ m bend radius.

Figure 9:
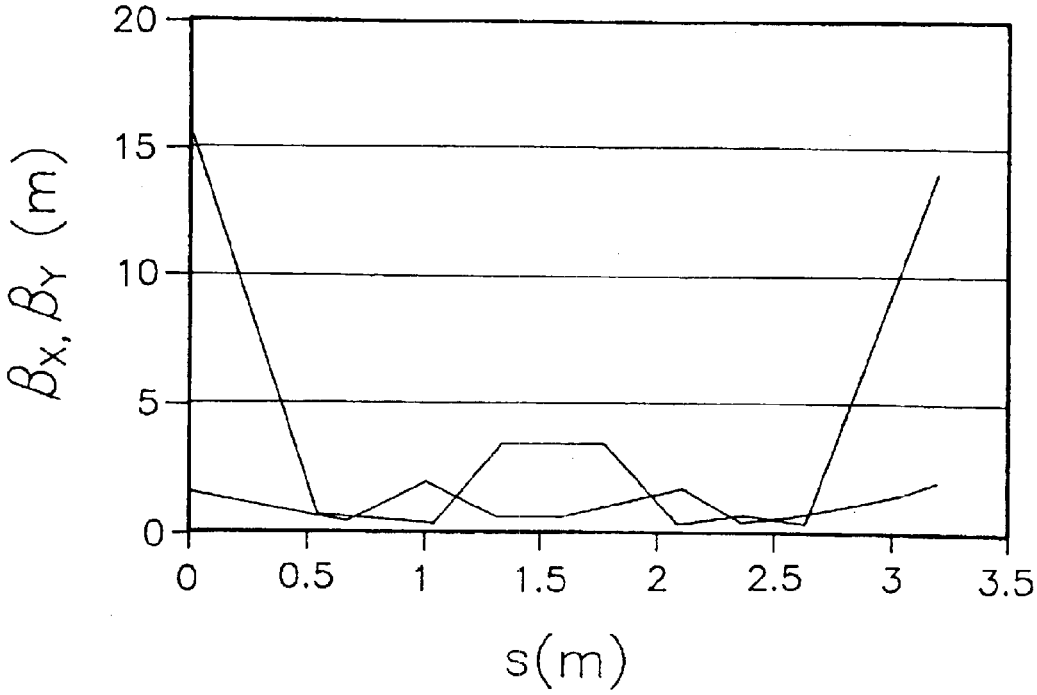
FIG. 9 is a graph showing the stability of beam envelopes produced using the bending geometry depicted in FIG. 7.

FIG. 8 illustrates the envelopes obtained using the alternative geometry of FIG. 3. A violent instability is apparent. FIG. 9 shows results for the same system while using the geometry of FIG. 7, with a 25° pole face rotation, at angle 53 between the incoming particle beam 22 and the face 54 of magnet 30, applied to the beam at the nondispersed faces of the magnet. The improvement in stability is apparent.

A number of features of the bend cell geometry described herein are particularly worthy of note:

1. All momentum components are dispersed by the first bend along parallel trajectories. A single dipole using this geometry could therefore be used as the basis of a magnetic spectrometer or spectrograph
2. The transverse position of the trajectory of a specific dispersed momentum component depends only linearly on its momentum. This is in contrast to the nonlinear dependence of the trajectory position when the conventional geometry of FIG. 2 is employed; the novel geometry described herein thus avoids imposition of nonlinear effects with their associated potential for beam quality degradation
3. The complete bending system is achromatic to all orders and thus will transport a beam of arbitrarily large momentum spread.

4. The path length of any specific momentum component depends only linearly on its momentum. Thus, the "momentum compaction" of this system is entirely linear. This is advantageous in the design of recirculation systems for the production of short, high-instantaneous-current beams, energy recovering accelerators, and/or energy compression systems.
5. The linear momentum compaction of such systems is small as compared to that of conventional systems. The path length variation of a two bend achromatic system with momentum is $\delta L/\delta(\Delta p/p)=2\ \rho(\theta-\sin\theta)$; this is in contrast with the variation in, for example, an achromatic four-dipole chicane with transverse offset D, which is ~2 Dθ. Thus, the transport is more nearly (though not exactly) isochronous for bend angles up to order 1 radian in magnitude.
6. The footprint of the system is small. A complete, 180° achromatic bend, with momentum compaction of order $M_{56}$~0.2 m, based on conventional electromagnets can be made for few-hundred MeV electrons with a footprint of order 1¼ m×2½ m. This is to be contrasted with, for example, systems with similar performance, such as the MIT/Bates and Jefferson Lab recirculators, which have footprints of order 6 m×6 m.

There has thus been described a novel bend cell and bend cell geometry that permits particle beam recirculation in a completely achromatic and nearly isochronous manner with all of the benefits attendant therewith that have been described above.

As the invention has been described, it will be apparent to those skilled in the art that the same may be varied in many ways without departing from the spirit and scope of the invention. Any and all such modifications are intended to be included within the scope of the appended claims.

What is claimed is:

1. A passive, particle beam bend cell comprising a pair of coplanar dipole magnets in reflective symmetry producing a magnetic field and a mechanism for introducing a particle beam into said magnetic field at an angle of incidence such that said magnetic field applies active bending to said particle beam only beyond the chord of the orbit for any momentum component of said particle beam and wherein each of said pair of dipole magnets has a face that is impacted by said particle beam and said face is modified such that a pole face rotation is applied to the particle beam at the point of incidence.

2. The particle beam bend cell of claim 1 wherein said pole face rotation is about 25°.

3. A method of bending a particle beam comprising introducing a particle beam into a passive, particle beam bend cell comprising a pair of coplanar dipole magnets in reflective symmetry producing a magnetic field and a mechanism for introducing a particle beam into said magnetic field at an angle of incidence such that said magnetic field applies active bending to said particle beam only beyond the chord of the orbit for any momentum component of said particle beam and wherein each of said pair of dipole magnets has a face that is impacted by said particle beam and said face is modified such that a pole face rotation is applied to the particle beam at the point of incidence.

4. The particle beam bend cell of claim 3 wherein said pole face rotation is about 25°.

* * * * *